United States Patent [19]

Cole

[11] Patent Number: 4,485,373

[45] Date of Patent: Nov. 27, 1984

[54] AUTOMATIC SECURITY MONITORING SYSTEM

[75] Inventor: Martin T. Cole, Keysborough, Australia

[73] Assignee: I. E. I (Australia) Proprietary Limited, Huntingdale, Australia

[21] Appl. No.: 442,372

[22] Filed: Nov. 17, 1982

Related U.S. Application Data

[63] Continuation of Ser. No. 216,641, Dec. 15, 1980, abandoned.

[30] Foreign Application Priority Data

Dec. 13, 1979 [AU] Australia ..... PE1708

[51] Int. Cl.[3] ..... G08B 19/00

[52] U.S. Cl. ..... 340/522; 340/505; 340/506; 340/511; 340/533; 340/825.05

[58] Field of Search ..... 340/505, 522, 506, 511, 340/518, 512, 517, 526, 533, 825.06, 825.14, 825.1, 825.05, 825.16, 825.54

[56] References Cited

U.S. PATENT DOCUMENTS

| | | | |
|---|---|---|---|
| 2,842,753 | 7/1958 | Ewen | 340/518 |
| 3,735,395 | 5/1973 | Getchell | 340/505 |
| 4,041,455 | 8/1977 | Norberg | 340/505 |

FOREIGN PATENT DOCUMENTS 474512 12/1975 Australia .

*Primary Examiner*—Donnie L. Crosland

*Attorney, Agent, or Firm*—Banner, Birch, Mckie & Beckett

[57] ABSTRACT

An automatic centralized monitoring security system having a plurality of detectors each capable of detecting and advising a malfunction of any given situation of either a routine or emergency nature and a responder associated in circuit with each detector, the arrangement being such that during normal operation the circuit is in dynamic equilibrium, and that upon a malfunction occurring to influence one or more detectors in the circuit an imbalance is created adapted to give rise to an alarm situation.

2 Claims, 3 Drawing Figures

AUTOMATIC SECURITY MONITORING SYSTEM

This is a continuation of application Ser. No. 216,641, filed Dec. 15, 1980 now abandoned.

The invention relates to an automatic centralized security monitoring system and particularly to apparatus providing individual annunciation from parallel detectors.

Detectors are automatic devices used to monitor the status of a situation, such as the incidence of fire, burglary, holdup, equipment malfunction, process phase, etc., whether of a routine or emergency nature. Electrically operating detectors are wired to a control panel, such that appropriate actions may be initiated e.g. the sounding of an alarm or the operation of a control device, such detectors hereinafter referred to as detectors of the type as herein defined. Systems may incorporate many and varied forms of detector. In order to reduce the cost of labour and materials, this invention permits the wiring of electrically operating detectors to a common parallel circuit, thereby obviating the need for individual wiring to each detector, yet maintaining recognition of the individual detector(s) which have operated.

Reference is made to Australian Pat. No. 474,512 which has the same basic aim as this invention. Previous designs have typically used direct current for monitoring the status of the detection circuit. For applications where malicious interference must be anticipated, direct current systems have a low resistance to tampering. Therefore, alternating current or pulse monitoring must be used.

One monitoring method would be the use of a transponding device at each detector. Each detector transponder would be interrogated in turn by equipment in the control panel. This equipment would send out a characteristic train of pulses or tonebursts, which would be recognized by only one detector transponder. This transponder would reply appropriately according to the status of its detector. Subsequent detector transponders would be similarly interrogated. A basically similar but more complex system is described in the pending U.S. patent application Ser. No. 869,009 filed Jan. 12, 1978. Therein there is described an automatic centralized monitoring system capable of monitoring various functions in a plurality of separate premises; comprising, a central station, said premises being linked to said central station, monitoring means in each of said premises, at least one line drive means located at said central station coupled to said premises, said line driver means being adapted to transmit an interrogation signal to said monitoring means, a computer means, said line driver means being under the control of said computer means for initiating said interrogation signals and said computer means including means for interpreting reply signals received from said monitoring means whereby a change of status such as a malfunction at any of said premises is detectable. Whilst such systems inherently have high tamper resistance, they are expensive and they consume power (i.e. they are "active" devices). The reticulation of this power can be inconvenient or costly.

Accordingly, it is the object of this invention to compromise whereby a good level of tamper resistance is achieved, while the equipment required at the detector is inexpensive and requires no power (i.e. is "passive" in operation).

There is provided according to the present invention an automatic centralized monitoring security system comprising a plurality of detector means each capable of detecting and advising the status in any given situation as defined herein, a responder means associated with each detector, the arrangement being such that during normal operation the circuit is in dynamic equilibrium, and that upon a malfunction occurring to influence one or more detectors in the circuit an imbalance is created adapted to give rise to an alarm situation.

There is also provided according to the present invention, an automatic centralized monitoring security system comprising a plurality of detectors each capable of detecting and advising the status in any given situation as defined herein, a resonant frequency device associated with each detector and a variable frequency generator means associated with said resonant frequency device, the arrangement being such that during normal operation the circuit is in dynamic equilibrium, and that upon a malfunction occurring to influence one or more detectors in the circuit, an imbalance is created which will give rise to an alarm situation.

Conveniently the resonant frequency device may be replaced by a timing device which is adapted to transmit pulses at preset times in use to provide a time-based profile signifying normal operation of the circuit, said detectors acting to indicate a malfunction when said normal profile is upset.

At each detector there is placed a resonant device of high selectivity Q. Each resonant device is tuned to a different frequency and is placed in parallel across the pair of wires comprising the detector circuit. Typically each detector has an output consisting of a closed switch contact, which opens in the event of detector activation. This switch contact is used to disconnect the resonant device.

An oscillator of swept frequency is wired across the detector circuit via a resistor. As the frequency sweeps through the resonant frequencies, there will be a marked dip in amplitude of this signal, on the detector circuit side of the resistor. These dips in amplitude are monitored in relation to the frequency being generated, such that each resonant circuit is identified (and numbered). Thus, should a detector activate, the appropriate dip will no longer appear. This will identify the particular detector.

To automate the process, the frequency sweep by the swept frequency oscillator can be digitally controlled and the dips can be recorded in a memory device. In this way a "profile" of the detector circuit is recorded. Any variation in this profile such as the disappearance of any dip, or the appearance of a new dip (due say to illegal substitution) will be detected. To accommodate the varying requirements of differing premises, in terms of the number of detectors, the spread in tolerance of resonant frequencies and the frequency response of the detector circuit cable itself, the memory can be individually programmed according to each premises. The control panel equipment can accordingly establish its own profile for the detector circuit, while the memory is in "write" mode. At this time, the equipment can automatically assign a number to each detector. Thereafter it remains in "read" mode and reports all variations in profile, in accord with the assigned numbers.

An alternative method for obtaining a profile is to incorporate the required number of resonant devices within the control panel, identical to those used on the detector circuit. These internal or reference resonant devices would replace the memory element.

The invention will now be described in more detail with reference to the accompanying diagrams.

BRIEF DESCRIPTION OF THE DRAWINGS

FIG. 1 is a block schematic illustrating the basic form of this invention. Several resonant devices (1) each having a different resonant frequency, are wired to a parallel circuit (2). A signal generator oscillator (3) generates an alternating current signal voltage across the parallel circuit via a resistor (4). The frequency of the signal is continuously varied (swept) by a modulator (5) which also advances the profile device (6). The amplitude of the signal across the parallel circuit will vary as the signal frequency is swept. The degree of variation is a function of the resistor value and the impedance change in a resonant device at its resonant frequency. These variations in amplitude are detected by a detector (7). The outputs of the detector and profile device are compared (8). Where a substantial deviation occurs between the profile and the detected signal, an alarm output device (9) is activated.

Figure 1:
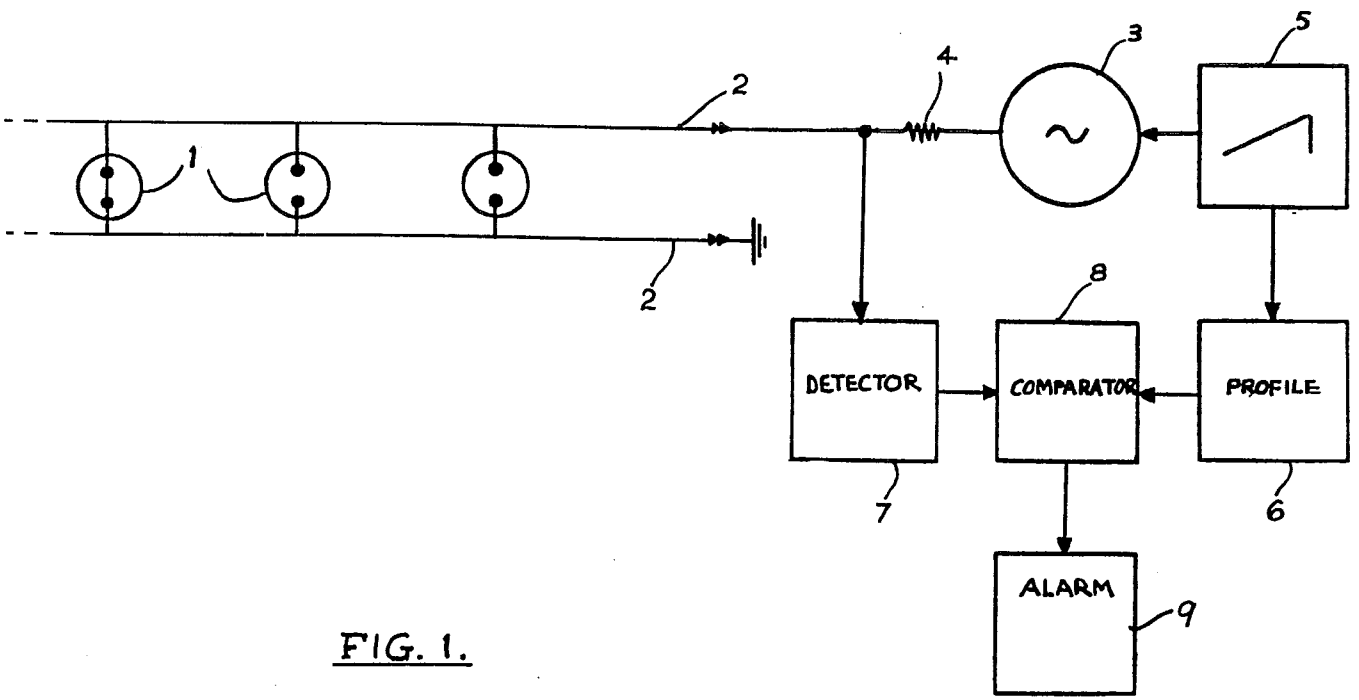
FIG. 1 is a block schematic illustrating a basic form of the invention.
Figure 2:
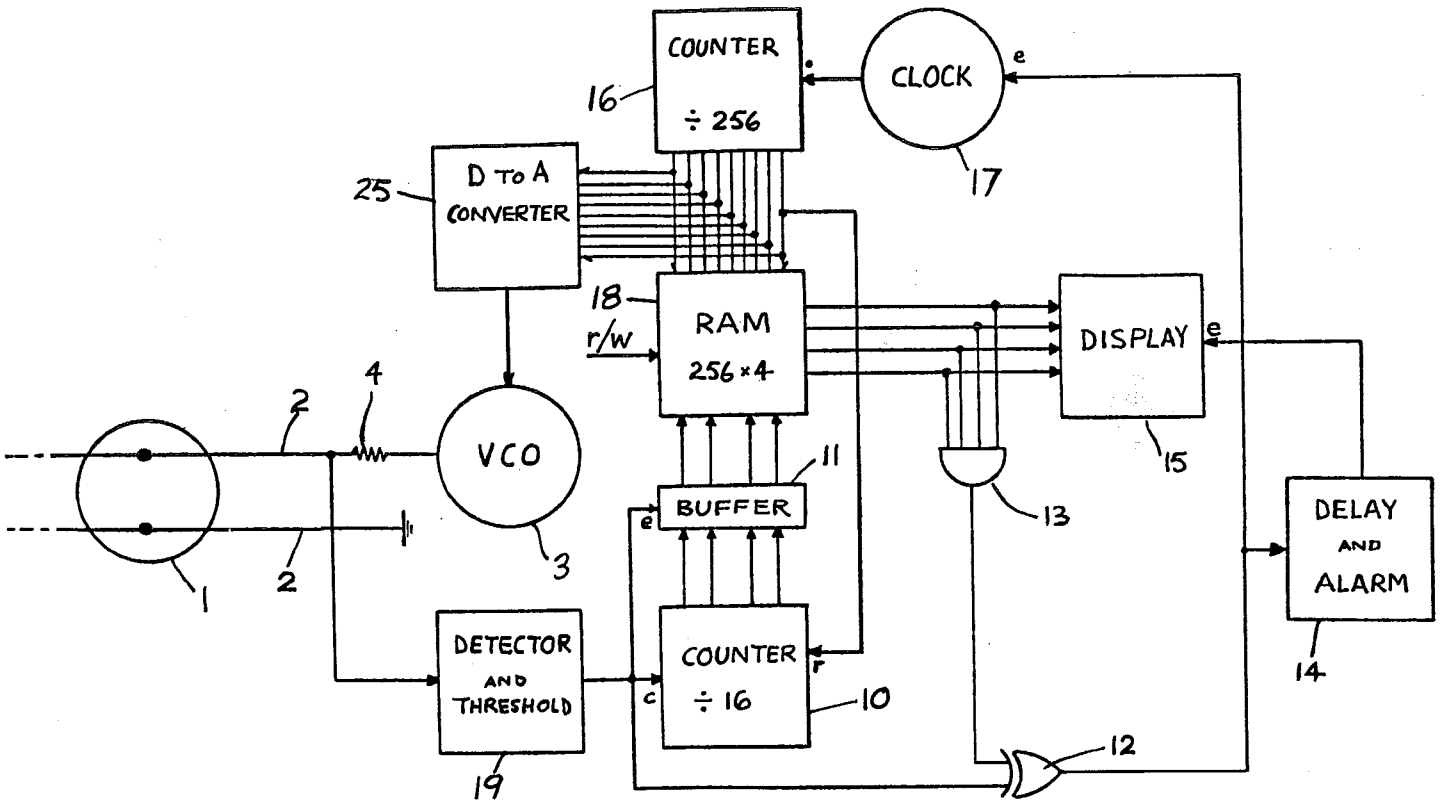
FIG. 2 is a block schematic illustrating a second form of the invention.

One form of the invention is described in FIG. 2. Several resonant devices (such as (1)) are wired to a parallel circuit (2) which is driven by a swept frequency signal via a resistance (4). This frequency is derived from a voltage-controlled oscillator (3), the linearity of which is not critical. The frequency is controlled by a digital to analog convertor (25) driven by a counter (16). A clock (17) is used to advance this counter at a convenient rate. The speed and stability of this clock are not critical. This counter is also used to address a random-access memory (18) which can be set to read or write mode. Also provided is a detector and threshold device (19) to locate the position of resonant dips with respect to the signal frequency and memory address. As a dip is reached, the counter (10) is advanced and the counter output is enabled by the buffer (11) to be presented to the data input of the random-access memory. With the memory in write mode, the value of the counter is stored at the current address. Thus a number is assigned to each dip. At frequencies where no dip is detected, the buffer ensures that a zero is stored in the current address. Thus, a complete profile of the parallel circuit is built up during a full sweep of the oscillator. With the memory now set to read mode, as the signal frequency advances, the detector output and memory output are compared for equality using an and-gate which detects that the current memory output is zero or non-zero, coupled to an exclusive-or gate which provides an output when the memory and detector are dissimilar. When any dissimilarity is detected, such as would occur if a resonant device was removed or if a new one appeared, then the clock is disabled and a delay timer (14) commences. This delay is used to overcome any transient interference. After this verification delay, a display (15) is enabled to identify the particular resonant device number, and the alarm output is activated.

Figure 3:
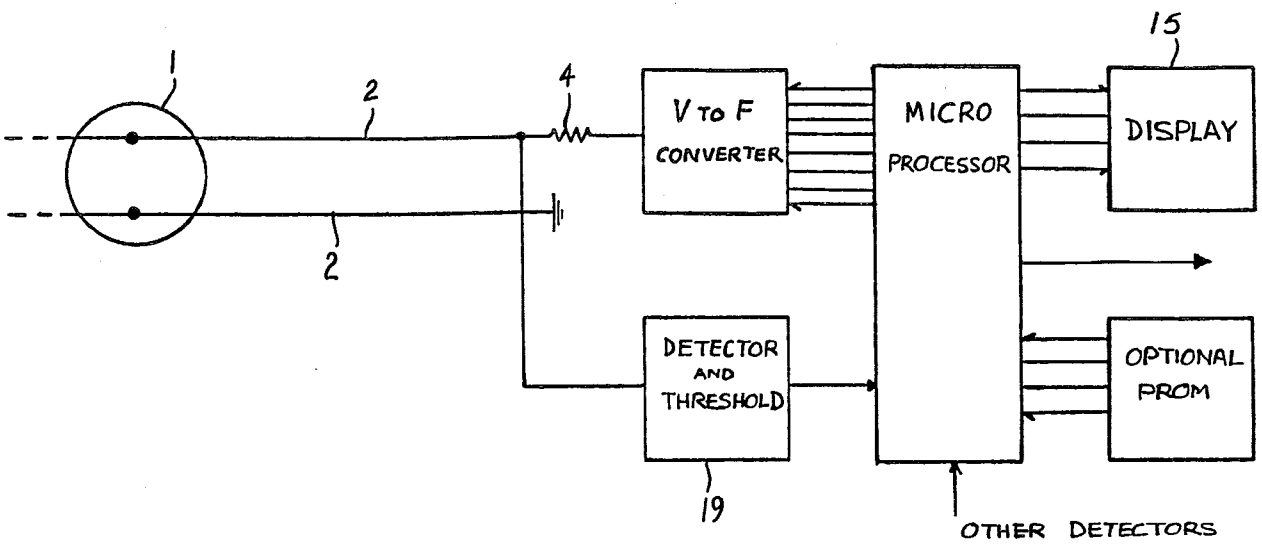
FIG. 3 is a simplified block circuit employing a microprocessor.

For ease of production, for reliability and for design flexibility, a microprocessor is used. The functions described in FIG. 2 are programmed in software, resulting in a greatly simplified circuit as shown in FIG. 3. Also provided is the option to accept the output of detectors or systems thereof, wired directly to the microprocessor (via suitable filtering). In addition, there is the option to connect a programmable, read-only memory (PROM) in which certain parameters have been stored. Such parameters would include the action to be taken in the event of particular detector activations, such as the provision of entry and exit delays, silent or audible alarm, day or night operation, normally closed or open switching, test functions, multiple-level arming, etc. Such options would be predetermined at the time of installation, or would be selectable by means of an additional keyboard control. Furthermore, the invention could readily interface to other equipment such as an automatic telephone dialer or a direct monitoring system connected to a central station, such as described in pending U.S. patent application Ser. No. 869,009 filed Jan. 12, 1978.

For situations where the use of a frequency-dependent monitoring method may be inconvenient or impracticable, the design shown in FIG. 2 may be modified for pulse detection. The digital to analog converter (25) and voltage controlled oscillator (3) are replaced by a switching device. This switching device applies voltage to the parallel circuit (2) via the resistor (4), under the control of the counter (16), for a set period.

Each resonant detector device such as (1) is replaced by a pulse transmitting device. A pulse device could be produced from a unijunction transistor and a time-delay resistor and capacitor. With such a configuration in use, each unijunction transistor causes a current pulse within the detector circuit, at preset times following the application of voltage across the detector circuit. Each current pulse causes a dip in voltage across the detector circuit, because of the resistor (4) and such dips are then detected by detector (19). A profile of the detector circuit may be recorded in the random-access memory (18). This profile may be time-based instead of frequency-based, but otherwise the operation of the circuit is very similar to that previously described. A similar configuration can be achieved using an integrated circuit timer.

The circuit of FIG. 3 may similarly be modified for pulse operation.

I claim:

1. An automatic centralized monitoring security system comprising a plurality of detectors each capable of detecting and advising the status in any given malfunction situation such as incidence of fire, burglary, hold up, equipment malfunction, or a process failure of either a routine or emergency nature, a timing device associated with each detector, means providing a synchronizing time base, said timing device being adapted to transmit electrical pulses at infinitely variable preset times relative to said synchronizing time base when in use to create an infinitely variable time based circuit profile which in normal operation is in dynamic equilibrium such that the system can adapt to slight changes in the circuit profile caused by ambient temperature based variations or component characteristic variations without giving rise to an alarm situation, the arrangement being such that upon said malfunction situation occurring to change said infinitely variable time based circuit profile, an imbalance in the equilibrium of said time based profile is created which imbalance gives rise to an alarm situation in the system.

2. A system as claimed in claim 1 wherein a resonant frequency device is substituted for said timing device, a variable frequency generator in circuit with said resonant frequency device, said generator adapted to generate a continuously and infinitely variable swept frequency, the arrangement being such that during normal operation of the system the circuit including said detectors is in dynamic equilibrium and exhibits a frequency base profile, said system being adaptable to slight changes in the circuit profile caused by ambient temperature based variations or component characteristic variations without giving rise to an alarm situation, and that upon a malfunction situation occurring to influence at least one of said detectors in the circuit, an imbalance in the dynamic equilibrium is created to give rise to an alarm situation in the system.

* * * * *